United States Patent [19]

Hasselbusch

[11] Patent Number: 4,837,937

[45] Date of Patent: Jun. 13, 1989

[54] ADJUSTABLE REAR SIGHT UNIT FOR A GUN

[76] Inventor: Harold Hasselbusch, 144-21 68th Dr., Flushing, N.Y. 11367

[21] Appl. No.: 226,797

[22] Filed: Aug. 1, 1988

[51] Int. Cl.[4] ..... F41G 1/10; F41G 1/26

[52] U.S. Cl. ..... 33/257; 33/261

[58] Field of Search ..... 33/252, 257, 258, 251, 33/254, 261, 253, 233; 42/100, 102

[56] References Cited

U.S. PATENT DOCUMENTS

| | | | |
|---|---|---|---|
| 747,350 | 12/1903 | Andrus | 33/261 |
| 862,717 | 8/1907 | Crandall | 33/252 |
| 1,055,801 | 3/1913 | Ross | 33/258 |
| 1,150,791 | 8/1915 | Swebilius et al. | 33/257 |
| 2,356,182 | 8/1944 | Schaich | 33/257 |
| 2,682,707 | 7/1954 | Dahlberg | 33/254 |
| 2,817,904 | 12/1957 | Lee | 33/258 |
| 3,792,534 | 2/1974 | Lowe, Jr. | 33/257 |
| 3,834,035 | 9/1974 | Merrill | 33/251 |
| 4,536,966 | 8/1985 | Engel | 33/257 |
| 4,551,920 | 11/1985 | Mahotra | 33/252 |

FOREIGN PATENT DOCUMENTS

| | | | |
|---|---|---|---|
| 1100510 | 2/1961 | Fed. Rep. of Germany | 33/233 |
| 0141708 | 5/1980 | German Democratic Rep. | 33/254 |
| 234606 | 2/1945 | Switzerland | 33/254 |

*Primary Examiner*—William A. Cuchlinski, Jr.
*Assistant Examiner*—Thomas B. Will
*Attorney, Agent, or Firm*—Nicholas J. Garofalo

[57] ABSTRACT

A rear gun sight unit including a head having a U-slot across which extends a screw provided with a notch for sighting a target, the screw being adjustable to carry the notch to the right or left of normal center for sighting under adverse wind conditions, the head being vertically adjustable relative to a supporting base to elevate the notch for sighting a distant target, and the slot having sidewalls and shoulders to the right and left of center adapted for quick sighting of the gun under various conditions of wind and distance at a momentarily movable target.

9 Claims, 1 Drawing Sheet

ADJUSTABLE REAR SIGHT UNIT FOR A GUN

BACKGROUND OF THE INVENTION

This invention relates to adjustable rear gun sights. More particularly, it is concerned with the provision of new and useful improvements in such devices whereby a rear gun sight is obtained which is of a simple and practical nature and is effective for the purposes intended.

It is the desire of gun enthusiasts that a rear gun sight be provided having components which are few in number, are of a non-complex structure and capable of being readily assembled. It is desired that such a gun sight be provided which is not only effective for the marksman in the sighting of fixed targets, but is also effective for the hunter in the sighting of momentarily movable game targets.

The rear gun sight of the present invention satisfies the need for a sight having the foregoing qualities. It is suited for a target within normal range under normal or adverse wind conditions, for sighting a target beyond normal range under normal or adverse wind conditions, and for sighting under these various conditions not only fixed targets but also momentarily movable targets.

The invention further lies in the particular structure and arrangement of its components as well as in their mode of association with one another to effect the objects and advantages intended herein.

BRIEF SUMMARY OF THE INVENTION

The rear sight of the present invention is a unit comprising a base member mounted atop the rear area, such as the receiver of a gun, and an upper member or head threadedly engaged upon a raised neck of the base member. The head includes a sighting element in the form of a screw extending across a U-slot defined between sidewalls of the head. The screw has a sighting notch in its midarea. The screw has a normal position in which the notch is centered relative to the slot for use in sighting a target under insignificant wind conditions. The screw is adjustable to carry the notch to the right or left of center for sighting a target under adverse wind conditions. The head is threadedly adjustable upwardly of the neck to elevate the notch for sighting a distant target. And the sidewalls of the slot and shoulders of the sidewalls provide means to either side of center selectively alignable with a front sight for quickly sighting at various ranges and under various wind conditions targets, such as game that are moving or likely to momentarily change position.

The foregoing structure of the invention, its features and advantages will become increasingly apparent as this specification unfolds in greater detail and as it is read in conjunction with the accompanying drawing wherein an embodiment of the invention is illustrated. It is to be expressly understood, however, that the drawing is for purposes of illustration and description, and it is not to be construed as defining the limits of the invention.

DETAILED DESCRIPTION OF THE INVENTION

The rear gun sight unit 1 embodying the invention, as illustrated in the accompanying drawing, serves in conjunction with a conventional front sight, not shown, for aiming a gun so as to obtain an effective discharge of a pellant under ideal as well as adverse wind conditions at a target located at various distances from the gun.

Figure 3:
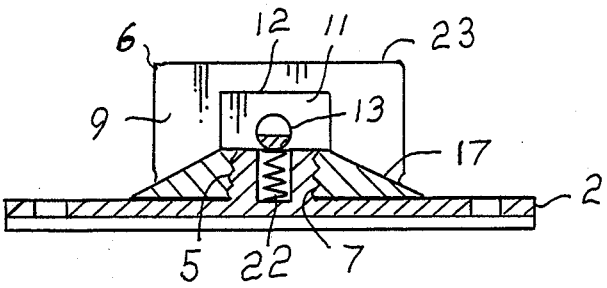
FIG. 3 is a section on line 3—3 of FIG. 1.
Figure 2:
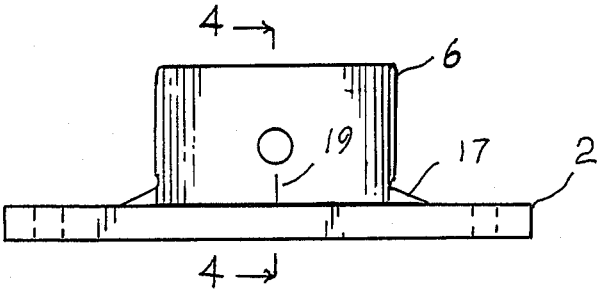
FIG. 2 is an elevational view of the unit from its right side.

The unit includes a base plate 2, here of rectangular form, adapted to be mounted, as by screws 3, atop a rear area, such as the receiver of a gun. Integral with and extending vertically up from the surface of the base plate is a threaded hub or neck 5. And seated upon the base plate is a cylindrical body or head 6 having flat top and bottom ends and provided with an axially extending threaded socket 7 in its bottom into which socket the neck is threadedly engaged, as appears in FIG. 3.

The head 6 serves as a means or sighting member for the sighting of a target. Extending transversely of the head above its socket is a slot 8 of a general U-form which open through the top end of the head. The slot is defined by an upper portion between opposed parallel sidewalls 9, and by a narrower lower portion between opposed parallel sidewalls 11. The latter are stepped in from walls 9 by shoulders 12. Walls 11 provide a desirable degree of support for the end portions of a sighting screw 13.

Screw 13 is of uniform diameter. It extends transversely of that narrow portion of the slot defined between walls 11, and its ends are engaged in opposed axially aligned threaded bores 14, **14*a*. Bore 14 extends only partway into the left wall 11, and the opposed bore 14*a* opens through both faces of the opposite right wall 11. The outer end of the screw is engageable by a screwdriver to enable the screw to be adjustably threaded relative to the head 6 to carry a sighting notch 15** in the screw to various selected positions relative to the U-slot to enable effective sighting of a target under attendant wind conditions.

Figure 4:
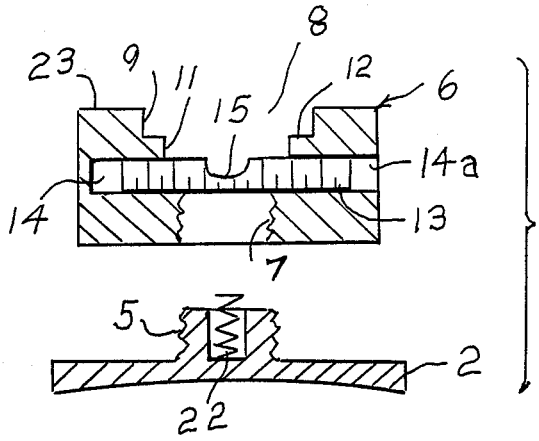
FIG. 4 is a section on line 4—4 of FIG. 2, but shows the base and upper members of the unit disengaged from one another.
Figure 1:
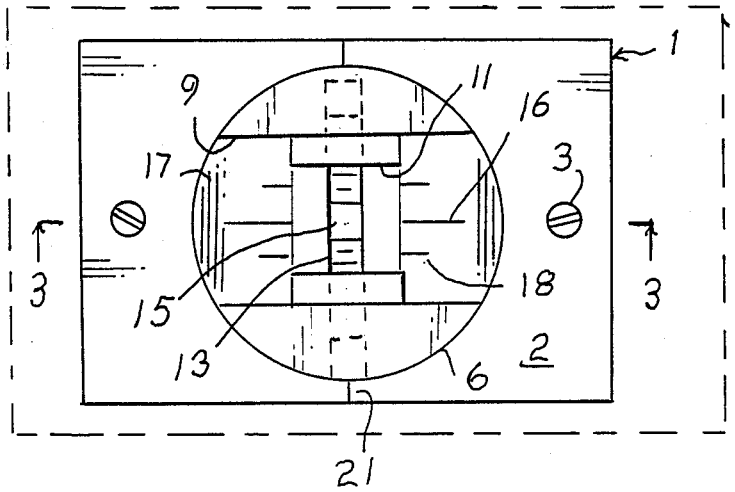
FIG. 1 is a plan view of an adjustable rear gun sight unit embodying the invention and shown as mounted upon the receiver of a gun.

The screw has a normal position, as in FIGS. 1, 4, in which the notch is centered relative to the sidewalls of the slot. In this normal position the center of the notch will be aligned with a guide line 16 marked upon opposed downwardly sloping areas 17 of the head. The screw is threadedly adjustable from its normal position inwardly or outwardly of the head, as may be needed to obtain selected positions of the notch to the right or left of center for effective sighting of a target. The inner faces of the walls 11, serve to indicate the limits to which the notch is to be adjusted to the right or left of center. The guide lines 18 marked on the opposed sloping areas 17 of the head are provided to conveniently indicate various positions to which the notch may be adjustably carried relative to center. The notch will have obtained its fully adjusted position to the left of center when the screw limits against the end of bore 14. The screw and the complementary bores in which it is threaded are provided with fine threads, whereby any adjusted position of the screw is made secure.

When sighting a target, the tendency of wind to force a travelling pellant to the right or left of its intended course must be considered. Under mild or insignificant wind conditions there will be negligible effect of the wind on the travel of a pellant. Under such conditions there will be no need for adjusting the position of the sighting screw from its center or normal position. But, when wind is significant, then the screw is to be adjusted to carry its notch sufficiently to the right or left of center for an effective sighting of a target accordingly as the wind is from the right or left.

The force of gravity acting upon the travel of a pellant fired from a gun tends to pull the pellant downward. Accordingly, when one takes into consideration the distance of the target from the point of fire, some elevation of the head 6 may be needed to obtain a proper sighting of the gun and effective travel of the pellant to its target.

Because of the high speed of a pellant moving over a predetermined short distance to its target, an adjustment in elevation of the head 6 would not be needed for sighting over short distances to obtain a target hit. But, when greater distances are encountered between the point of fire and the target, some elevation of the head is desirable. At such times the head may be adjustably threaded upwards relative to the neck 5 to the extent deemed appropriate to obtain a desired elevation of the notch for effective sighting of the gun at the distant target. In making the adjustment, the head is rotated about the threaded neck to the extent desired. Each one-half turn of the head will be indicated by an alignment of guide lines 19 marked on opposite sides of the head with guide lines 21 marked on the base plate 2.

To ensure against any looseness developing in an adjustment made of the head relative to the neck, fine threads are provided in the socket 7 and on the neck 5. Further, the upper end of the socket opens into the U-slot below the screw, and a spring 22 seated in a bore of the neck projects upwardly from the neck sufficiently to exert a pressure upon the screw that will further ensure retention of both the screw and the head in their adjusted positions.

Adjustments of the sighting screw to counter wind conditions when sighting a gun, and adjustments of the head for elevation of the sighting notch for distant targets are primarily made for sighting fixed targets, as in target practice and in contests. On the other hand, the target of the hunter in the field is not always fixed or stationary. It is game which is moving or expected to momentarily move from one position to another. Under such conditions, the hunter must aim and fire quickly, lest he lose his target. He does not have the time to make sighting adjustments that may be needed where wind or distance are important factors.

However, the rear gun sight unit of the present invention is formed to also enable effective sighting of the hunter's game target when quick action is required to avoid loss of the target. To this end, according to the extent of adverse wind conditions and accordingly as the wind is from the right or left, the hunter may use the inner faces of either of the sidewalls 9 or 11 in conjunction with the conventional front sight for a swift and effective sighting of the target. And where immediate elevated sighting is required for a distant target, the hunter may use either the lower shoulders 12 or the upper shoulders 23 of the head in conjunction with the conventional front sight to obtain an effective elevated sighting of the target.

A further feature in the structure of the sighting head 6 is provided which in effect sets the sighting screw 13 on a peak so as to allow a distinct and clear sighting of a target through the notch 15. In this respect, the body of the head beneath the sighting screw slopes downward, as at 17, from opposite sides of the screw.

While an embodiment of the invention has been illustrated and described in detail, it is to be expressly understood that the invention is not limited thereto. Various changes in form, design or arrangement may be made in its components without departing from the spirit and scope of the invention. It is my intent, therefore, to claim the invention not only as shown and described, but also in all such forms and modifications or equivalents thereof as might be construed to be within the spirit of the invention, when considered in the light of the specification, the drawing and the appended claims.

What is claimed is:

1. A rear gun sight unit comprising a body having a vertically extending slot in a top end thereof and having a vertically extending threaded socket in a bottom end thereof, a base plate mountable atop a rear area of a gun and having a vertically extending neck threadedly engaged in the socket, a sighting screw of substantially uniform diameter extending across opposed walls of the slot and threadedly engaged in its end portions in complementary bores in the walls of the slot, the screw having a sighting notch in its midarea disposed between the walls of the slot, the body having a normal condition seated upon the base plate and adapted to being adjustably threaded upwardly of the neck to elelvate the sighting notch, and the screw being threadedly ajustable relative to the walls of the slot to selectively vary the position of the notch between the walls from a normal center position to either side of center.

2. A rear gun sight unit as in claim 1, wherein the slot is defined as having an upper wide portion between opposed upper wall portions of the slot and as having a lower narrower portion between lower wall portions of the slot stepped in by shoulders from the upper wall portions.

3. A rear gun sight unit as in claim 2, wherein the body is cylindrical and has flat top and bottom ends.

4. A rear gun sight unit as in claim 3, wherein the flat top ends and the stepped in shoulders respectively define upper and lower sights selectively employable for sighting a target.

5. A rear gun sight unit comprising a cylindrical body having a vertically extending U-slot opening out of a top end thereof and having an axially extending threaded socket in its bottom end, a base plate mountable atop a rear area of a gun and having a vertically extending neck threadedly engaged in the socket, a sighting screw extending across opposed walls of the U-slot and threadedly engaged in its end portions in complementary bores formed in the walls of the U-slot, the screw having a sighting notch in its midarea disposed between the walls of the U-slot, the body having a normal condition seated upon the base plate and adapted to being adjustably threaded upwardly of the neck to elevate the plane of the screw and the notch, and the screw being threadedly adjustable relative to the walls of the U-slot to selectively vary the position of the notch between the walls from a normal center position to either side of center.

6. A rear gun sight unit as in claim 5, wherein the body tapers from beneath the screw downwardly and away from opposite side areas of the screw to the base plate, whereby the screw with its notch has a peak position between the walls of the U-slot.

7. A rear gun sight unit as in claim 6, wherein a central marking is provided on the tapered areas which is indicative of a position centrally of the U-slot with which the notch is normally in register.

8. A rear gun sight unit as in claim 7, wherein markings are provided on the tapered areas spaced to each side of the central marking with which markings the position of the notch may be selectively brought into register.

9. A rear gun sight unit as in claim 5, wherein markings on opposed side areas of the body are registrable with complementary markings on the base plate accordingly as the body is rotated each one-half turn about the neck relative to the base plate.

* * * * *